United States Patent [19]

Takahashi

[11] Patent Number: 4,802,451

[45] Date of Patent: Feb. 7, 1989

[54] MECHANICAL GOVERNOR FOR FUEL INJECTION PUMP, WITH REACTION FORCE ADJUSTING MECHANISM FOR GOVERNOR CONTROL LEVER

[75] Inventor: Masaatsu Takahashi, Higashimatsuyama, Japan

[73] Assignee: Diesel Kiki Co., Ltd., Tokyo, Japan

[21] Appl. No.: 65,335

[22] Filed: Jun. 22, 1987

[30] Foreign Application Priority Data

Jun. 30, 1986 [JP] Japan ..... 61-153753

[51] Int. Cl.[4] ..... F02M 39/00

[52] U.S. Cl. ..... 123/373; 123/374; 123/365

[58] Field of Search ..... 123/373, 374, 365, 370, 123/371, 364

[56] References Cited

U.S. PATENT DOCUMENTS

| | | | |
|---|---|---|---|
| 4,340,020 | 7/1982 | Caldicott | 123/374 |
| 4,621,601 | 11/1986 | Kupzik | 123/374 |
| 4,664,079 | 5/1987 | Sakuranara | 123/374 |

FOREIGN PATENT DOCUMENTS

| | | | |
|---|---|---|---|
| 0032239 | 3/1978 | Japan | 123/373 |
| 54-4583 | 2/1979 | Japan | 123/373 |
| 0001830 | 1/1986 | Japan | 123/373 |
| 0717384 | 2/1980 | U.S.S.R. | 123/373 |

*Primary Examiner*—Carl Stuart Miller

*Attorney, Agent, or Firm*—Frishauf, Holtz, Goodman & Woodward

[57] ABSTRACT

A mechanical governor for a fuel injection pump of an internal combustion engine. A governor control lever is mounted on a casing of the governor for pivotal movement about a pivotal axis between first and second extreme angular positions corresponding respectively to a release position and a maximum depression position of an accelerator pedal. A main spring biases the control lever so at to gradually increases a reaction force acting thereupon in proportion to pivotal movement of the control lever from the first extreme angular position toward the second extreme angular position. A reaction force adjusting spring has one end associated with the control lever to adjust the reaction force acting thereupon due to the main spring. A link mechanism connected to the control lever and to the other end of the reaction force adjusting spring is operative in response to the pivotal movement of the control lever to substantially translate a line connecting the one and other ends of the reaction force adjusting spring, across the pivotal axis of the control lever, to thereby appropriately adjust the reaction force acting upon the control lever regardless of the angular position thereof.

5 Claims, 3 Drawing Sheets

MECHANICAL GOVERNOR FOR FUEL INJECTION PUMP, WITH REACTION FORCE ADJUSTING MECHANISM FOR GOVERNOR CONTROL LEVER

BACKGROUND OF THE INVENTION

The present invention relates to a mechanical governor for a fuel injection pump for use in internal combustion engines and, more particularly, to a mechanism for adjusting reaction force acting upon a governor control lever.

A fuel injection pump for internal combustion engines such as a diesel engine and the like comprises a control rack connected to a plunger of the injection pump, for regulating the fuel injection amount injected thereby. Movement of the control rack is controlled by a mechanical governor which, in general, utilizes centrifugal force and which actuates the injection pump in such a manner as to maintain a predetermined relationship between the fuel injection amount from the injection pump and the engine rotational speed. The mechanical governor comprises a governor control lever connected to an accelerator pedal for displacing the control rack in response to a depression amount of the accelerator pedal.

In general, a single main spring is attached to the governor control lever, which serve as return biasing force accumulating means for biasing the control lever in such a direction as to return or release the accelerator pedal, to return the control lever with high response at the shift of the accelerator pedal from its depression position to its lease position. It is required to apply appropriate biasing force or reaction force in the return direction to the governor control lever in accordance with its angular position. With the above-described arrangement having the signal main spring, however, such a situation would arise that the biasing force acting upon the governor control lever in the return direction increases proportionally in accordance with increase in the angular position or lever angle of the control lever. More specifically, as the lever angle of the governor control lever becomes smaller, the biasing force of the main spring gradually diminishes. Thus, the reaction force applied to the governor control lever gradually decreases, so that the return characteritic of the control lever or responsiveness with which the control lever returns becomes deteriorated. On the other hand, as the lever angl becomes larger, the reaction force applied to the control lever gradually increases, so that the biasing force of the main spring which pulls the control lever in the returning directing greatly inoreases and as a result a very large force or accelerator pedal-stepping force is required to maintain the control lever in a desired angular position in which the lever assumes a large angle. This results in degradation in operability of the control rack with respect to movement of the accelerator pedal.

To cope with the aforesaid situation. a lever reaction force-reducing device has been proposed, e.g. in Japanese Utility Model Publication (Kokoku) No. 54-4583, in which a balance spring is employed for applying, to the control lever, a moment acting in a direction opposite to the direction of the reaction force acting upon the control lever due to the main spring, to reduce the reaction force in proportion to the lever angle of the control lever. In the lever reaction force-reducing device, one end of the balance spring is fixedly secured to a casing of the mechanical governor, and the other end of the balance spring is connected to the control lever through an adjusting plate member such that the other end is angularly movable relative to the one end in response to pivotal movement of the control lever. Thus, a line of action of tension of the balance spring is pivotally displaced about the one end of the balance spring in response to pivotal movement of the control lever so as to move across the pivotal axis of the control lever, in order that the gradually increasing or decreasing biasing force of the main spring is gradually reduced or increased in accordance with the pivotal displacement of the line of action, depending upon the line of action is located on one side of the pivotal axis of the control lever or on the opposite side thereof. With such lever reaction force-reducing device, however, the freedom or range of movement of the balance spring is small, because the one end thereof is fixedly secured to the casing of the mechanical governor. Therefore, it is not possible to sufficiently secure a range of variation in the moment produced by the tension of the balance spring and its distance of action which moment is necessary for reducing the reaction force acting upon the governor control lever. There is, as a matter of course, a limit in an extent within which it is possible to appropriately reduce the reaction force acting upon the control lever due to the main spring. In particular, since the maximum value of the aforesaid moment is low, it is difficult to reduce the reaction force when it is maximum. Thus, the operability of the control lever still remains to be improved.

SUMMARY OF THE INVENTION

It is an object of the invention to provide a reaction force adjusting mechanism for a governor control lever of a mechanical governor for a fuel injection pump, which can appropriately adjust the reaction force applied to the control lever regardless of an angular position thereof, making it possible to sufficiently improve the operability of the control lever.

According to the invention, there is provided a mechanical governor of a fuel injection pump of an internal combustion engine having an accelerator pedal, the mechanical governor comprising:

a casing;

a governor control lever mounted to the casing for pivotal movement about a pivotal axis between a first extreme angular position corresponding to a release position of the accelerator pedal and a second extreme angular position corresponding to a maximum depression position of the accelerator pedal;

first biasing means for biasing the governor control lever so as to gradually increase a reaction force acting thereupon as a function of the pivotal movement of the governor control lever from the first extreme angular position toward the second extreme angular position;

second biasing means having one end connected to the governor control lever for applying a biasing force thereto so as to adjust the reaction force acting upon the governor control lever due to the first biasing means; and a link mechanism connected to the governor control lever, the second biasing means having the other end connected to the link mechanism, the link mechanism being operative in response to the pivotal movement of the governor control lever about the pivotal axis, to substantially translate a line connecting the one and other ends of the second biasing means to each other, across the pivotal axis of the governor control lever.

According to the invention, there is further provided a mechanical governor of a fuel injection pump of an internal combustion engine having an accelerator pedal, the mechanical governor comprising:

a casing;

a governor control lever mounted to the casing for pivotal movement about a pivotal axis between a first extreme angular position corresponding to a release position of the accelerator pedal and a second extreme angular position corresponding to a maximum depression position of the accelerator pedal;

an auxiliary control lever connected to the governor control lever for pivotal movement together with the governor control lever about the pivotal axis, the auxiliary control lever having an arcuate guide slot;

an adjusting member passing through the arcuate guide slot for adjusting a relative angular position between the governor control lever and the auxiliary control lever;

first biasing means for biasing the governor control lever so as to gradually increase a reaction force acting thereupon in proportion to the pivotal movement of the governor control lever from the first extreme angular position toward the second extreme annular position;

second biasing means having one end connected to the auxiliary control lever for applying a biasing force to the governor control lever through the auxiliary control lever so as to adjust the reaction force acting upon the governor control lever due to the first biasing means; and a link mechanism connected to the governor and auxiliary control levers, the second biasing means having the other end connected to the link mechanism, the link mechanism being operative in response to the pivotal movement of the governor and auxiliary control levers about the pivotal axis, to substantially translate a line connecting the one and other ends of the second biasing means to each other, across the pivotal axis of the governor and auxiliary control levers.

The above and other objects, features and advantages of the invention will become more apparent from the ensuing detailed description taken in conjunction with the accompanying drawings.

DETAILED DESCRIPTION

The invention will now be described in detail with reference to the drawings showing embodiments thereof.

Figure 1:
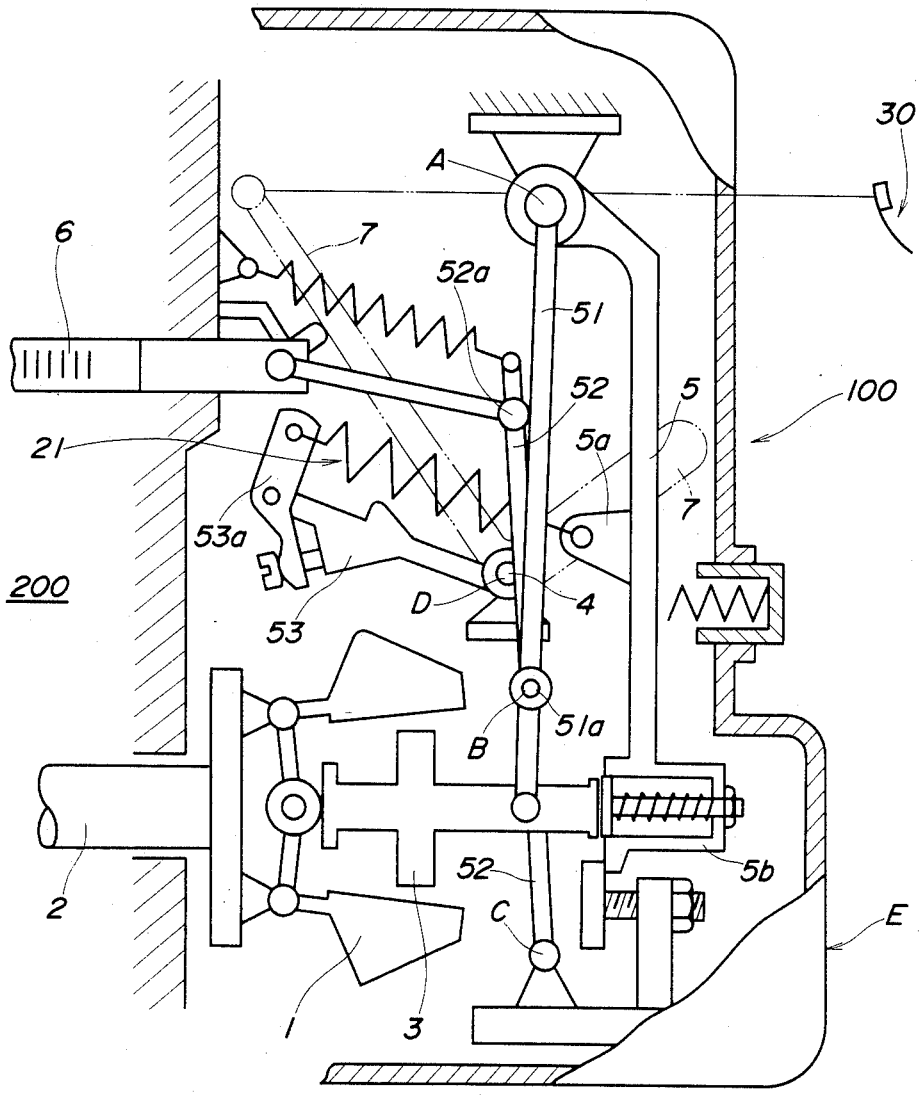
FIG. 1 is a longitudinal cross-sectional view showing a mechanical governor for a fuel injection pump, which is equipped with a reaction force adjusting mechanism for a governor control lever according to a first embodiment of the invention.

Referring to FIG. 1, there is illustrated an entire arrangement of a mechanical governor for a fuel injection pump, equipped with a reaction force adjusting mechanism for a governor control lever according to a first embodiment of the invention. The mechanical governor, generally designated by reference numeral 100. has a casing E and is mounted on an outer side surface of the fuel injection pump 200. Flyweight members 1 are mounted on a camshaft 2 which transmits rotation of the fuel injection pump 200 and disposed such that as the rotational speed of the camshaft 2 increases, the flyweight members 1 are displaced radially outwardly due to a centrifugal force, to urge a control sleeve 3 in the rightward direction as viewed in FIG. 1, with an urging force increasing correspondingly to the increased rotational speed of the camshaft 2. A tension level 5 has a longitudinally intermediate portion **5*a* to which is connected one end of a main spring 21 as first biasing means, of which the pulling force acts upon the tension lever 5 to cause same to pivotally move about its pivot A in the clockwise direction. This in turn causes a lower end portion 5*b* of the tension lever 5 to urge the control sleeve 3 to the right with an urging force corresponding to the pulling force of the main spring 21. The control sleeve 3 is responsive to the difference between the rightward urging force of the flyweight members 1 corresponding to the rotational speed of the camshaft 2 and the leftward urging force of the tension lever 5 corresponding to the pulling force of the main spring 21 so that it moves to the right as the rightward urging force increases with an increase in the rotational speed of the camshaft 2, whereby the tension lever 5 is pivotally moved in the counterclockwise direction. Following the pivoal movement of the tension lever 5, a guide lever 51 mounted on the common pivot A for the tension lever 5 is pivotally moved about the pivot A in the counterclockwise direction. This causes a floating lever 52 pivotally connected to a longitudinally intermediate portion 51*a* of the guide lever 51 to pivotally move about its pivot C in the clockwise direction as viewed in FIG. 1 so that an upper portion 52*a* of the floating lever 52 moves to the right as viewed in FIG. 1. Consequently, a control rack 6 connected to the tip portion 51*a* of the floating lever 52 and to a plunger, not shown, of the fuel injection pump 200 is moved to the right as viewed in FIG. 1 to reduce an amount of fuel to be injected from the fuel injection pump 200 into an internal combustion engine, not shown. In general, the control rack 6 is connected to the plunger of the fuel injection pump 200** in such a manner that the fuel injection amount is reduced with increase in the engine rotational speed to prevent excessively rapid increase in the engine rotational speed.

The main spring 21, which has its one end connected to the tension lever 5 as noted before, has the other end connected ro a tip portion **53*a*. Of a swivel lever 53. The swivel lever 53 has the opposite end secured to a rotary shaft 4, referred to later, for pivotal movement together with a governor control lever, shown by a two-dot chain line in FIG. 1, also secured to the rotary shaft 4. Thus, if the governor control lever 7 is rotated so that the swivel lever 53 is also pivotally moved in the counterclockwise direction as viewed in FIG. 1, the pulling force of the main spring 21 acting upon the tension lever 5 increases. The increase of the pulling force of the main spring 21 causes a change in the balance between the two opposed urging forces acting upon the control sleeve 3 to move same to the left as viewed in FIG. 1 so that the control rack 6** is moved to the left to increase the fuel injection quantity.

The governor control lever (hereinafter merely referred to as the "control lever") 7 has a generally V-shaped configuration, with which is associated a reaction force-adjusting mechanism according to the first embodiment of the invention, and is supportedly secured to the rotary shaft 4 which penetrates through a side wall of a casing E for pivotal movement therewith, and arranged outside the casing E. The control lever 7 is connected to an accelerator pedal 30 such that as the accelerator pedal 30 is stepped on, the control lever 7 is pivotally moved about the axis of the rotary shaft 4 in the counterclockwise direction as viewed in FIG. 1, and as the accelerator pedal is released from its stepped position the control lever is pivotally moved about the rotary shaft 4 in the clockwise direotion. In FIG. 1, the control lever 7 is shown to be in the maximum stepped position.

As stated before, as the control lever 7 is rotated in the clockwise or counterclockwise direction as viewed in FIG. 1, the pulling force of the main spring 21 exerted upon the tension lever 5 is decreased or increased. To be specific, it is so arranged that as the control lever 7 is pivotally moved in the counterclockwise direction as viewed in FIG. 1, the pulling force of the main spring 21 increases so that the tension lever 5 is pivotally moved about its pivot A in the clockwise direction as viewed in FIG. 1, while as the control lever 7 is pivotally moved in the clockwise direction, the pulling force of the main spring 21 decreases.

Therefore, as the accelerator pedal 30 is stepped on to pivotally move the control lever 7 in the counterclockwise direction as viewed in FIG. 1, the tension lever 5 is pivotallv moved about the pivot A in the clockwise directing so that the rightward urging force acting upon the control sleeve 3 increases to move same to the left as viewed in FIG. 1 and accordingly the floating lever 52 is pivotally moved about the pivot C in the counterclockwise direction to move the control rack 6 to the left, i.e. in tbe direction of increasing the fuel quantity.

Figure 2:
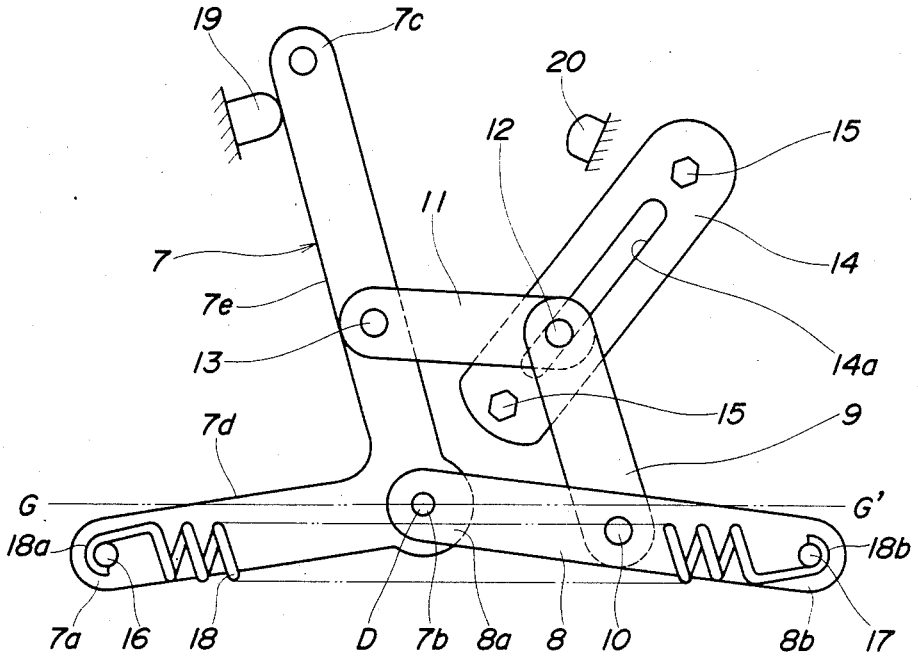
FIG. 2 is an enlarged fragmental view showing the reaction force adjusting mechanism illustrated in FIG. 1, in which the covernor control lever is in a first extreme angular position corresponding to a release position of an accelerator pedal.
Figure 3:
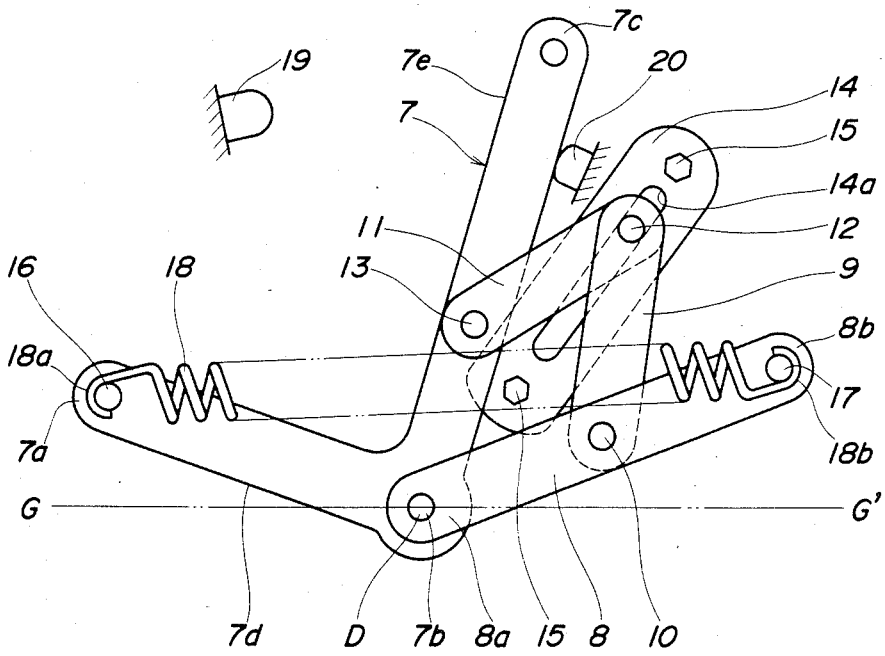
FIG. 3 is a view similar to FIG. 2, but showing the governor control lever which is in a second extreme angular position corresponding to a maximum depression position of the accelerator pedal.

FIGS. 2 and 3 show only the control lever 7 and the reaction force-adjusting mechanism associated therewith, for explanation of construction and operation thereof. In the figures, the control lever 7 and the reaction force-adjusting mechanism are viewed from an side opposite to the side from which they are viewed in FIG. 1. As described previously, the control lever 7 is supported by the rotary shaft 4 for pivotal movement therewith and arranged exteriorly of the casing E. The reaction force-adjusting mechanism comprises a link mechanism which includes a first link lever 8 having one end 8*a* pivotally connected to the control lever 7 and the rotary shaft 4 through the pivot D. A second link lever 9 has one end pivotally connected to a longitudinally intermediate portion of the first link lever 8 through a first pin 10. A third link lever 11 has one end pivotally connected to the other end of the second link lever 9 through a second pin 12. The other end of the third link lever 11 is pivotally connected, through a third pin 13, to a longitudinally intermediate portion of the second arm 7*e* of the control lever 7 between the tip end 7*c* and the center of pivotal movement 7*b* or the pivot D. The second pin 12 is slidably received in an elongated guide slot 14*a* fromed in a guide plate 14 which is fixedly secured to an outer side surface of the casing E (FIG. 1) by means of bolts 15 and 15'. A reaction force adjusting spring 18 serving as second biasing means is interposed under tension between a first hooking pin 16 fixedly attached to the tip end 7*a* of the first arm 7*d* of the control lever 7 and a second hooking pin 17 fixedly attached to the other end 8*b* of the first link lever 8.

The tip end 7*c* of the second arm 7*e* of the control lever 7 is capable of being abutted against first and second stoppers 19 and 20 which are fixedly secured to the casing E and arranged outside same. The first stopper 19 is located at a first extreme angular position of the control lever 7, which corresponds to the release position of the accelerator pedal 30, while the second stopper 20 is located at a second extreme angular position of the control lever 7, which corresponds to the maximum depression position of the accelerator pedal 30.

As stated previously, the reaction force acting upon the control lever 7 due to biasing force of the main spring 21 serving as first biasing means gradually increases as the lever 7 moves from the release position of the accelerator pedal 30, i.e. the first extreme angular position at the first stopper 19, toward the maximum depression position of the accelerator pedal 30, i.e. the second extreme angular position at the second stopper 20.

The operation of the reaction force-adjusting mechanism for the control lever 7 constructed as described above will now be described.

As shown in FIG. 2, when the accelerator pedal 30 (FIG. 1) is in the release position, with the tip end 7*c* of the second arm 7*e* of the control lever 7 in abutment against the first stopper 19, the line of action of tension of the reaction force adjusting spring 18 is located in a position below the center of pivotal movement or the pivot D as viewed in FIG. 2, i.e. below a straight line (hereinafter referred to as "dead center line G - G'") connecting the first hooking pin 16, the pivot D and the second hooking pin 17 to each other when they are straight aligned with each other or located along a straight line. That is, the tip end 7*c* of the second arm 7*e* of the control lever 7 is pivotally biased in the counterclockwise direction as viewed in FIG. 2. Accordingly, when depression is released from the accelerator pedal 30, the reaction force-adjusting mechanism acts upon the control lever 7 such that the tip end 7*c* is brought into abutment against the of irst stopper 19. Thus, it can be prevented by the biasing force of the reaction force adjusting spring 18 in addition to the weak biasing force of the main spring 21, that the control lever 7 remains at an unstable position.

On the other hand, when the accelerator pedal 30 is depressed to the maximum depression postion, i.e. when the control lever 7 pivotally moves from the position illustrated in FIG. 2 in the clockwise direction about the center of pivotal movement or the pivot D so that the tip end 7*c* is brought into abutment against the second stopper 20 as shown in FIG. 3, motion of the link mechanism following the pivotal movement of the control lever 7 causes the second pin 12 to move along the guide slot 14*a* of the guide plate 14. During this movement, the line of action of biasing force of the reaction force adjusting spring 18 is displaced to a position above the center of pivotal movement 7*b* or the pivot D of the control lever 7 as viewed in FIG. 3. In this manner, as the line of action of biasing force moves beyond the aforesaid dead center line G - G', the reaction force adjusting spring 18 biases the control lever 7 toward the second stopper 20 against the biasing force of the main spring 21.

Figure 4:
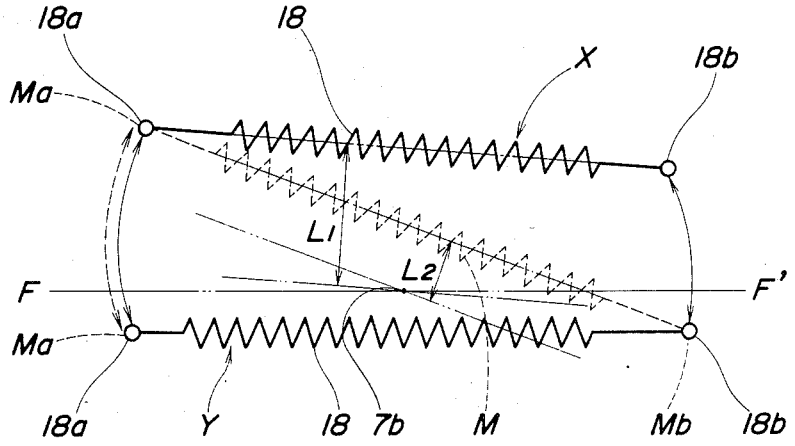
FIG. 4 is a schematic plan view useful for explanation of the operation of the reaction force adjusting mechanism illustrated in FIGS. 1 through 3, based on movement of a reaction force adjusting spring.

Paying attention to motion of the reaction force adjusting spring 18, the principle of operation of the reaction force-adjusting mechanism according to the first embodiment of the invention will next be described with reference to FIG. 4.

As the reaction force adjusting spring 18 employed in the first embodiment has the opposite ends 18*a* and 18*b* move following the pivotal movement of the control lever 7, the aforementioned line of action of biasing force of the spring 18 is translated across the dead center line G - G', as described above, between positions X and Y. Accordingly, when the accelerator pedal 80 is in the maximum depression position where the greatest force is required for reducing the reaction force acting upon the control lever 7, the reaction force adjusting spring 18 is displaced to the position X in FIG. 4. As a result, the arm length of the rotation moment contributing to the reaction reducing force, i.e. the distance between the center of pivotal movement 7*b* and the line of action of biasing force takes a value of $L_1$ in the illustrated embodiment. In contradistinction to the embodiment of the invention, in the case of the previously discussed prior art in which the reaction force adjusting spring M has one end Mb fixedly secured to the casing of the mechanical governor and the other end Ma movable following the pivotal movement of the control lever, the arm length of the rotation moment at the maximum depression position of the accelerator pedal takes a value $L_2$ less than $L_1$. The reason for this is that because the one end Mb of the reaction force adjusting spring M is fixed, the freedom or range of movement of the spring M is limited. In the reaction force-adjusting mechanism according to the invention, it is possible to obtain tbe force for reducing the reaction force, which is greater than that obtained by the prior art construction, because the ends 18*a* and 18*b* of the reaction force adjusting spring 18 are both movable.

Further, the one end 18*b* of the reaction force adjusting spring 18 of the illustrated embodiment is attached to the pin 17 on the other end 8*b* of the first link lever 8. With such arrangement, when the line of action of biasing force of the spring 18 is located at a position above the dead center line G - G' as shown in FIG. 3, the force acting upon the pin 17 to which the end 18*b* of the spring 18 is attached acts as an effective force for reducing the reaction force acting upon the control lever 7 by virtue of the action of the link mechanism having link levers 9 and 11 and guide plate 14, that is, by virtue of the obliquely upward movement of the second pin 12 along the guide slot 14*a* as viewed in FIG. 3. Thus, by the combination of the effect that the arm length of the rotation moment increases and the effect that the force of the reaction force adjusting spring 18 acts effectively upon the pin 17 to cause the link mechanism 9, 11 and 14 to pivotally move the control lever 7 in the clockwise direction as viewed in FIG. 3, there is provided such an advantage that the force acting upon the control lever 7 for reducing the force of the main spring 21 is made large as compared with the prior art.

Figure 5:
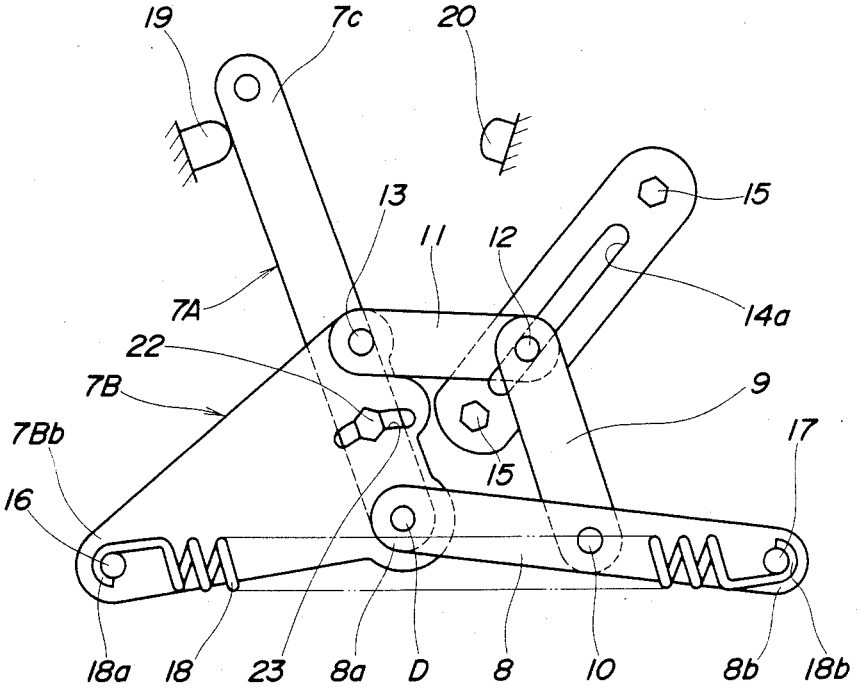
FIG. 5 is a view similar to FIG. 2, but showing a second embodiment of the invention.

FIG. 5 shows a reaction force-adjusting mechanism according to a second embodiment of the invention. In the second embodiment, a generally triangular auxiliary control lever plate 7B is mounted at its first corner on an elongated plate-like governor control lever 7A through the pivot D for pivotal movement together with the control lever 7A about the pivot D. An adjusting bolt 22 serving as an adjusting member passes through an arcuate slot 23 formed in the auxiliary control lever plate 7B, and is threadedly engaged with the control lever 7A, so that the relative angular position between the control lever 7A and the auxiliary control lever 7B can be adjusted by the cooperation of the adjusting bolt 22 and the arcuate slot 23. One end of the third link lever 11 is pivotally connected to the third hooking pin 13 fixedly secured to a second corner of the auxiliary control lever plate 7B. The reaction force adjusting spring 18 is interposed under tension between the first hooking pin 16 fixedly secured to a third corner 17*b* of the auxiliary control lever plate 7B and the second hooking pin 17 fixedly secured to the one end 8*b* of the first link lever 8.

With the reaction force-adjusting mechanism constructed as described above, if the lever angle of the control lever 7A with respect to the casing of the mechanical governor changes with time, for example, if the tension of the main spring 21 varies, the adjusting bolt 22 is moved along the arcuate slot 23 to adjust the relative angular position between the control lever 7A and the auxiliary control lever plate 7B. Thus, it is possible to adjust the lever angle of the control lever 7A with respect to the casing of the mechanical governor in such a manner that the fuel injection amount from the fuel injection pump is brought to an optimum value with respect to the depression amount of the accelerator pedal, in spite of the change in the lever angle with time. Other construction and operation of the second embodiment are substantially similar to those of the abovedescribed first embodiment. In FIG. 5, like reference numerals are used to designate parts and components like or similar to those shown in FIGS. 1 through 3, and description of such like or similar parts and components will therefore be omitted to avoid duplication.

What is claimed is:

1. A mechanical governor for a fuel injection pump of an internal combustion engine having an accelerator pedal, said mechanical governor comprising:

a casing;

a governor control level mounted to said casing for pivotal movement about a pivotal axis between a first extreme angular position corresponding to a release position of said accelerator pedal and a second extreme angular position corresponding to a maximum depression position of said accelerator pedal;

first biasing means for biasing said governor control lever so as to gradually increase a reaction force acting thereupon as a function of the pivotal movement of said governor control lever from said first extreme angular position toward said second extreme angular position; and second biasing means having one end connected to said governor control lever and another end supported by said casing for applying a biasing force to said governor control lever so as to adjust the reaction force acting upon said governor control lever due to said first biasing means, said one end of said second biasing means being shifted in response to the pivotal movement of said governor control lever;

a link mechanism arranged between said another end of said second biasing means and said casing and connecting them to each other, said link mechanism being operative in response to the pivotal movement of said governor control lever about said pivotal axis for shifting said another end of said second biasing means relative to said casing, to substantially parallelly translate a line connecting said one and said another ends of said second biasing means to each other, across said pivotal axis of said governor control lever.

2. a mechanical governor as defined in claim 1, wherein said link mechanism comprises:

a first link lever having one end connected to said governor control lever for pivotal movement about said pivotal axis and another end to which said another end of said second biasing means is connected;

a second link lever having one end pivotally connected to a longitudinally intermediate portion of said first link lever;

a guide plate fixedly secured to said casing and having an elongated guide slot;

a pin received in said elongated guide slot of said guide plate for sliding movement therealong, said second link lever having another end connected to said pin for pivotal movement about an axis thereof; and a third link lever having one end connected to said pin for pivotal movement about the axis thereof, and another end pivotally connected to said governor control lever.

3. A mechanical governor for a fuel injection pump of an internal combustion engine having an accelerator pedal, said mechanical governor comprising:

a casing;

a governor control lever mounted to said casing for pivotal movement about a pivotal axis between a first extreme angular position corresponding to a release position of said accelerator pedal and a second extreme angular position corresponding to a maximum depression position of said accelerator pedal;

an auxiliary control lever connected to said governor control lever for pivotal movement together with said governor control lever about said pivotal axis, said auxiliary control lever having an arcuate guide slot;

an adjusting member passing through said arcuate guide slot for adjusting a relative angular position between said governor control lever and said auxiliary control lever;

first biasing means for biasing said governor control lever so as to gradually increase a reaction force acting thereupon as a function of the pivotal movement of said governor control lever from said first extreme angular position toward said second extreme angular position;

second biasing means having one end connected to said auxiliary control lever for applying a biasing force to said governor control lever through said auxiliary control lever so as to reduce the reaction force acting upon said governor control lever due to said firsr biasing means; and a link mechanism connected to said governor and auxiliary control levers, said second biasing means having another end connected to said link mechanism, said link mechanism being operative in response to the pivotal movement of said governor and auxiliary control levers about said pivotal axis, to substantially translate a line connecting said one and another ends of said second biasing means to each other, across said pivotal axis of said governor and auxiliary control levers.

4. A mechanical governor as defined in claim 3, wherein said auxiliary control lever has a first corner pivotally connected to said governor control lever at said pivotal axis, a second corner to which said one end of said second biasing means is connected, and a third corner, and wherein said link mechanism comprises:

a first link lever having one end connected to said governor control lever for pivotal movement about said pivotal axis, and another end to which said another end of said second biasing means is connected;

a second link lever having one end pivotally connected to a longitudinally intermediate portion of said first link lever;

a guide plate fixedly secured to said casing and having an elongated guide slot;

a pin received in said elongated guide slot of said guide plate for sliding movement therealong, said second link lever having another end connected to said pin for pivotal movement about an axis thereof; and a third link lever having one end connected to said pin for pivotal movement about the axis thereof, and another end pivotally connected to said third corner of said auxiliary control lever.

5. A mechanical governor for a fuel injection pump of an internal combustion engine having an accelerator pedal, said mechanical governor comprising:

a casing;

a governor control lever mounted to said casing for pivotal movement about a pivotal axis between a first extreme angular position corresponding to a release position of said accelerator pedal and a second extreeme angular position corresponding to a maximum depression position of said accelerator pedal;

first biasing means for biasing said governor control lever so as to gradually increase a reaction force acting thereupon as a function of the pivotal movement of said governor control lever from said first extreme angular position toward said second extreme angular position;

second biasing means having one end connected to said governor control lever for applying a biasing force to said governor control lever so as to adjust the reaction force acting upon said governor control lever due to said first biasing means; and a link mechanism connected to said governor control lever, said second biasing means having another end which is connected to said link mechanism, said link mechanism being operative in response to the pivotal movement of said governor control lever about said pivotal axis, to substantially translate a line connecting said one and said another ends of said second biasing means to each other, across said pivotal axis of said governor control lever;

said link mechanism comprising:

a first link lever having one end connected to said governor control lever for pivotal movement about said pivotal axis, and another end to which said another end of said second biasing means is connected;

a second link lever having one end pivotally connected to a longitudinally intermediate portion of said first link lever;

a guide plate fixedly secured to said casing and having an elongated guide slot;

a pin received in said elongated guide slot of said guide plate for sliding movement therealong, said second link lever having another end connected to said pin for pivotal movement about an axis thereof; and a third link lever having one end connected to said pin for pivotal movement about the axis thereof, and another end pivotally connected to said governor control lever.

* * * * *